United States Patent [19]

Ito et al.

[11] Patent Number: 4,462,961

[45] Date of Patent: Jul. 31, 1984

[54] ALUMINUM ALLOY FOR CASTING

[75] Inventors: Tadao Ito, Fuji; Akio Hashimoto, Numazu, both of Japan

[73] Assignee: Nippon Light Metal Company Limited, Tokyo, Japan

[21] Appl. No.: 436,670

[22] Filed: Oct. 26, 1982

[30] Foreign Application Priority Data

Oct. 28, 1981 [JP] Japan ..... 56-171507

[51] Int. Cl.[3] ..... C22C 21/02

[52] U.S. Cl. ..... 420/534; 420/535

[58] Field of Search ..... 420/534, 535; 148/417, 148/439

[56] References Cited

U.S. PATENT DOCUMENTS 3,205,069 9/1965 Wood ..... 420/534

*Primary Examiner*—R. Dean

*Attorney, Agent, or Firm*—William J. Daniel

[57] ABSTRACT

An aluminum alloy for casting purposes contains over 6% and up to 13% by weight of silicon, over 2% and up to 55% by weight of copper, over 0.25% and up to 1% by weight of magnesium, over 0.1% and up to 0.5% by weight of nickel, and over 0.03% and up to 1% by weight of antimony, in addition to aluminum and impurities. The copper and magnesium have a ratio by weight of about 3:1 to 8:1.

4 Claims, 3 Drawing Figures

ALUMINUM ALLOY FOR CASTING

BACKGROUND OF THE INVENTION

1. Field of the Invention

This invention relates to an aluminum alloy for casting purposes which is superior in castability, strength, and resistance to heat, thermal shock and permanent deformation by heat.

2. Description of the Prior Art

Aluminum has recently come to use for a wide range of applications including the manufacture of vehicles and machines. As a result, there has been a strong need for an aluminum alloy for casting purposes which is superior in strength and heat resistance.

The inventors of this invention have succeeded in developing a previously proposed (hereinafter indicated as previous alloy) casting alloy which is superior in castability, strength and heat resistance, as disclosed in Japanese Laid-Open Patent Specification No. 69234/1980. The previous alloy contains over 6% and up to 13% of silicon, over 3% and up to 5% of copper, over 0.2% and up to 1% of magnesium and over 0.03% and up to 1% of antimony, the balance being aluminum and impurities. It has a maximum strength which is as high as 40 kg/cm$^2$, and an elongation of 3 to 4%, and is by far superior in thermal shock resistance to any conventionally known alloy of this kind**. It is, therefore, suitable for use in the manufacture of a part of a machine which repeatedly exposed to intense heat, for example, a piston in an engine.

**(for example, Japanese Industrial Standard for aluminum casting alloys "AC8A" and "AC8B")

Further research of the inventors has, however, indicated that the previous alloy has a number of defects. They have found that if a piston made of this alloy is used for a long time, that portion of the piston which has been exposed to heat repeatedly undergoes a permanent volumetric shrinkage which is different from that resulting from ordinary thermal expansion and contraction, and that the shrinkage enlarges the clearance between the piston and the cylinder, resulting in a blowby or piston slap. Moreover, the alloy is liable to lamellar abrasion, for example, in a groove in which a piston ring is fitted, resulting in failure of the ring to function properly.

SUMMARY OF THE INVENTION

It is an object of this invention to improve the drawbacks of the alloy as hereinabove described, while maintaining its excellent properties, and thereby provided an aluminum alloy which is suitable for use in the casting of machine parts which are trouble-free even after exposure to heat for a long time.

The inventors have found that the addition to the previous alloy of nickel in a quantity of over 0.1% and up to 0.5% by weight and of copper and magnesium in a ratio by weight of about 3:1 to 8:1 is effective for preventing the aforesaid volumetric shrinkage and improving the wear resistance of the alloy without causing any appreciable reduction in its excellent properties, including strength and thermal shock resistance.

According to this invention, there is, thus, provided an aluminum alloy for casting purposes which contains over 6% and up to 13% by weight of silicon, over 2% and up to 5% by weight of copper, over 0.25% and up to 1% by weight of magnesium, over 0.1% and up to 0.5% by weight of nickel and over 0.03% and up to 1% by weight of antimony, the balance being aluminum and impurities, the copper and magnesium having a ratio by weight of about 3:1 to 8:1.

The alloy of this invention is excellent in thermal properties including thermal shock resistance, and resistance to lamellar abrasion, and substantially free from any permanent volumetric shrinkage even after long exposure to high temperatures. Therefore, it is suitable for use in the manufacture of machine parts which have to be exposed to high temperatures, for example, a piston in an engine.

DETAILED DESCRIPTION OF THE INVENTION

Figure 1:
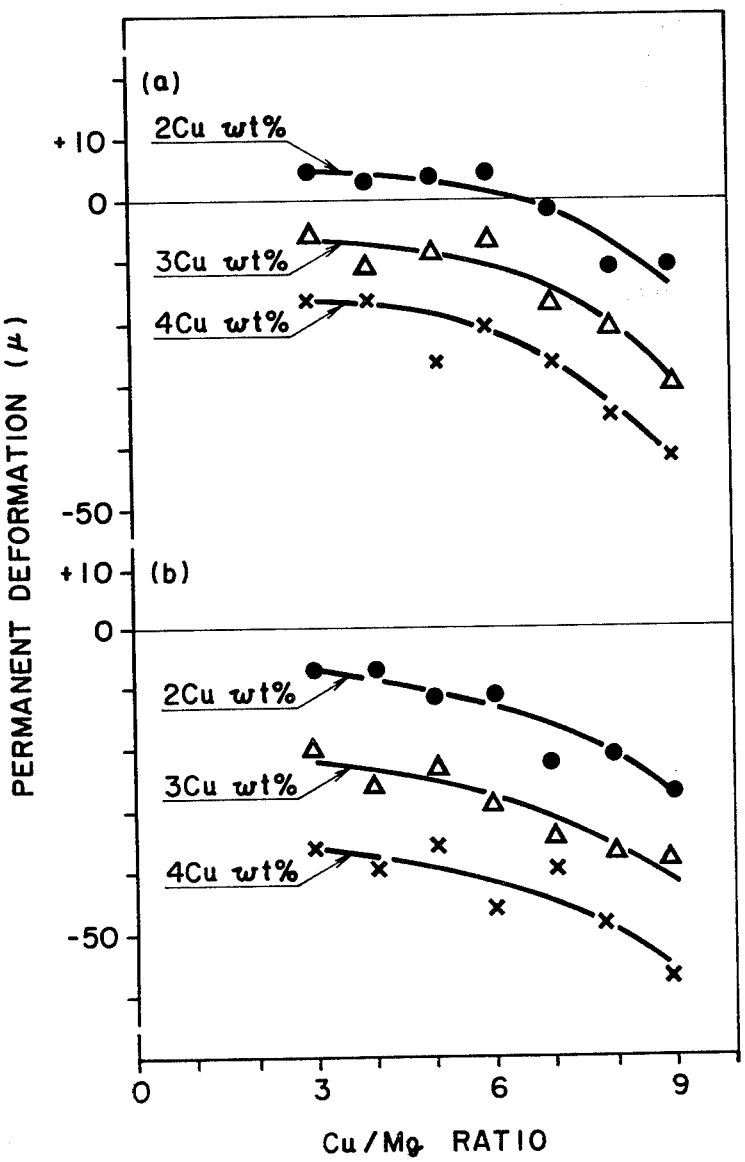
FIG. 1 shows the permanent volumetric change occurring in alloy castings after a long period of exposure to a high temperature, relative to the ratio of copper to magnesium, in alloys containing nickel in accordance with this invention at (a), and in alloys free of nickel at (b)

Silicon is an element which is essentially required for reinforcing the alloy, imparting wear resistance thereto and improving its castability. The full advantages of the use of silicon cannot be expected from its addition in the quantity of 6% by weight or less, while the use of 13% by weight or more of silicon may result in a reduction in the toughness and thermal shock resistance of the alloy.

Copper contributes to improving the strength of the alloy by artificial aging. If only 2% by weight or less of copper is employed, however, it is impossible to expect any effective improvement of the alloy strength, while the use of 5% by weight or more of copper should also be avoided, since too large a quantity of an intermetallic compound formed between aluminum and copper, which is not in the form of a solid solution, is likely to remain in the matrix, and cause a reduction in the toughness and fatigue resistance of the alloy, and a higher susceptibility of a casting to cracking.

Magnesium contributes to improving the strength of the alloy, since an intermetallic compound composed of magnesium and silicon, or aluminum, copper and magnesium is precipitated by artificial aging. If only 0.25% by weight or less of magnesium is employed, however, such precipitation may not take place in a sufficient quantity, while the use of magnesium in a quantity above 1% by weight should also be avoided, since it brings about a drastic reduction in the toughness and thermal shock resistance of the alloy, and seriously impairs the effect of antimony on the alloy structure.

Antimony improves the alloy structure to thereby elevate its thermal shock resistance markedly. The use of only 0.03% by weight or less is, however, insufficient, and amounts above 1% fail to produce any corresponding improvement in results.

Nickel prevents any appreciable permanent shrinkage of the alloy upon exposure to high temperature, and improves its resistance to wear by spalling. Only 0.1% by weight or less is, however, insufficient, while the use of 0.5% by weight or more may result in a drastic reduction in the thermal shock resistance of the alloy. Nickel exhibits its effectiveness in the prevention of any such shrinkage where the copper and magnesium in the alloy have a ratio by weight of about 3:1 to 8:1. If this ratio is not met, the use of nickel may not prove fully effective.

The alloy of this invention may contain impurities such as iron, zinc, vanadium and chromium, in those quantities which are usually present in the raw materials from which the alloy is formed. It also unavoidably contains small quantities of elements, such as titanium, boron and beryllium, as a result of its molten bath treatment. These impurities do not exert any adverse effect on the quality of the alloy. The presence of titanium is even beneficial, since it serves to improve the shrinkage of any casting produced from the alloy.

In order to improve the thermal resistance of the alloy, it is effective to add more than 0.1% but not more than 0.5% by weight of zirconium and/or more than 0.1% but not more than 1% by weight of manganese.

The invention will now be described in further detail with reference to several examples which demonstrate the outstanding advantages of this invention.

EXAMPLE 1

Effects of the presence of nickel and the ratio of copper and magnesium on permanent deformation of a casting by a long period of exposure to heat Various aluminum alloys of different compositions were tested for permanent deformation as a high temperature. They contained 11% by weight of silicon, 0.15% by weight of antimony, 2, 3 or 4% by weight of copper, and magnesium in a quantity giving a copper to magnesium ratio by weight of 3:1, 6:1 or 9:1. Some of the alloys additionally contained nickel, while the other alloys did not. FIG. 1 shows the test results for the castings of the alloys containing nickel at (a), and for the castings of the alloys free of nickel at (b).

The test samples of each alloy were prepared by casting in a boat-shaped mold conforming to the requirements of JIS for mold #4, subjecting the casting to solution heat treatment at 500° C. for 10 hours, quenching it in water, subjecting it to eight hours of tempering at 200° C., and precision forming it into a round bar having a diameter of 200 mm and a length of 90 mm. The samples were heated to 350° C. for 50 hours continuously, and after they had been air cooled, they were examined for dimensional changes along their length.

The alloys containing 2% by weight of copper contained 0.2% by weight of nickel, while the other alloys contained 0.4% by weight of nickel.

As is obvious from FIG. 1(*b*), the samples of the alloys not containing nickel underwent volumetric shrinkage as a result of 50 hours of heating at 350° C. This tendency became more prominent with increasing copper content of the alloy, and increasing copper to magnesium ratio therein. The problem of such deformation was, however, improved remarkably in the samples of the alloys containing an appropriate quantity of nickel in accordance with this invention, as is obvious from FIG. 1(*a*).

EXAMPLE 2

Mechanical Properties

The alloys of this invention were compared in mechanical properties with a conventional alloy designated by JIS as AC8A, and composed of aluminum, silicon, copper magnesium and nickel. The chemical analysis of each alloy employed is shown in Table 1, and its mechanical properties in Table 2 below. Samples No. 1 to 6 represent the alloy of this invention. Sample No. 6 was a forged product formed from a columnar casting having a diameter of 100 mm and a length of 300 mm by soaking at 480° C. for two hours, and forging at a temperature of 420° C. ro 450° C. Sample No. 7 was of the conventional AC8A alloy.

TABLE 1

| | Chemical analysis (wt. %) | | | | | | | | | | |
|---|---|---|---|---|---|---|---|---|---|---|---|
| No. | Si | Cu | Mn | Mg | Sb | Ti | Ni | Zr | Al | Cu/Mg | |
| 1 | 7.2 | 2.7 | — | 0.45 | 0.10 | 0.1 | 0.4 | — | Bal. | 6:0:1 | Invention |
| 2 | 8.0 | 2.7 | — | 0.46 | 0.10 | — | 0.4 | 0.3 | " | 5:7:1 | " |
| 3 | 9.2 | 3.3 | — | 0.82 | 0.15 | — | 0.4 | — | " | 4:0:1 | " |
| 4 | 9.1 | 3.5 | 0.8 | 0.81 | 0.15 | — | 0.4 | — | " | | |
| 5 | 11.2 | 4.6 | — | 0.91 | 0.15 | — | 0.4 | — | " | 5:0:1 | " |
| 6 | 9.3 | 3.4 | 0.7 | 0.90 | 0.15 | 0.1 | 0.4 | 0.3 | " | 3:8:1 | " |
| 7 | 12.1 | 1.0 | — | 1.10 | — | 0.1 | 1.8 | — | " | 0:9:1 | AC8A |

TABLE 2

| No. | Tensile strength ($kg/mm^2$) | 0.2% yield strength ($kg/mm^2$) | Elongation (%) | Hardness (HB) | Heat treating conditions: Solution heat treatment/quenching/aging |
|---|---|---|---|---|---|
| 1 | 31.4 | 26.0 | 4.6 | 98 | 500° C., 6 h/water/200° C., 8 h |
| 2 | 31.8 | 27.9 | 4.1 | 103 | 500° C., 6 h/water/200° C., 8 h |
| 3 | 32.5 | 29.8 | 3.8 | 110 | 500° C., 6 h/water/200° C., 8 h |
| 4 | 32.7 | 30.0 | 3.3 | 115 | |
| 5 | 33.7 | 31.6 | 3.1 | 119 | 500° C., 6 h/water/200° C., 8 h |
| 6 | 34.6 | 30.6 | 5.0 | 118 | 500° C., 1 h/water/200° C., 8 h |
| 7 | 29.7 | 28.9 | 0.7 | 109 | 500° C., 10 h/water/200° C., 8 h |

As is obvious from Table 2, the alloys of this invention are not only comparable to the conventional alloy in strength, but also are far superior in elongation and, therefore, in toughness.

EXAMPLE 3

Resistance to wear by spalling

The purpose of this example was to ascertain the resistance of a machine part formed from the alloy of this invention to lamellar abrasion under circumstances where it was subjected to repeated compressive stress at a high temperature, for example, the spalling wear-resistance of a piston in an automobile engine.

Figure 2:
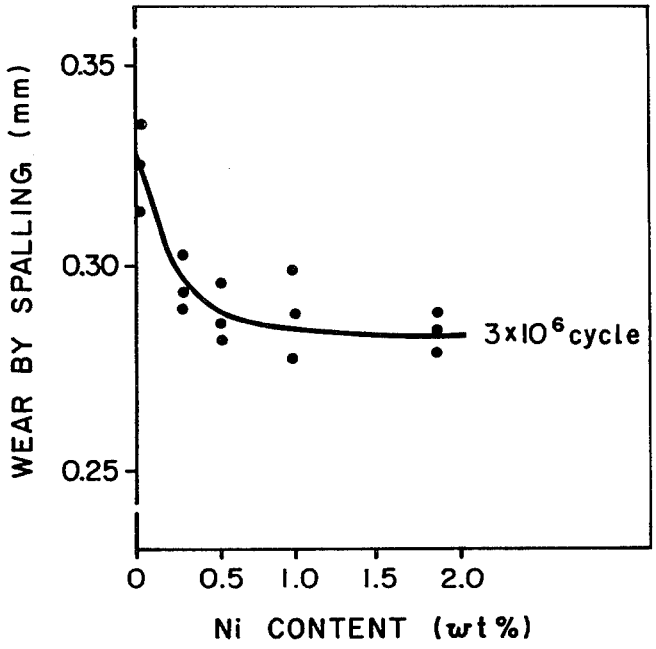
FIG. 2 shows the relation between the weight percentage of nickel in the alloys of this invention and their resistance to wear by spalling.

The test results are shown in FIG. 2. Each test sample was maintained at a high temperature, and subjected to repeated compressive stress with a maximum load of 100 kg and a minimum load of 10 kg by a 10 mm dia, steel ball in a "FRICTOLON" (trade name) friction tester (Model EMP-III-B·F-855). The depth of the depression thereby formed was measured. The tests were conducted at 300° C., and the application of compressive stress was repeated at a rate of 2,700 cycles per minute.

The samples were prepared from aluminum alloys of different compositions containing 9% by weight of silicon, 3% by weight of copper, 1% by weight of magniesum, 0.15% by weight of antimony, and 0, 0.2, 0.5, 1.0 or 2.0% of nickel by casting in a #4 boat-shaped mold confirming the JIS, six hours of solution heat treatment of 500° C., quenching in water, and eight hours of tempering at 200° C.

As is obvious from FIG. 2, the samples showed a drastic reduction in wear when the alloy contained about 0.2% by weight of nickel, and the samples prepared from the alloys containing 0.5% by weight or more of nickel showed only a small degree of wear which was substantially constant at the different nickel contents of the alloy above about 0.5%. The test results, thus, teach that it is sufficient to add up to 0.5% by weight of nickel in order to improve resistance to wear by spalling of the alloy.

EXAMPLE 4

Thermal shock resistance

Figure 3:
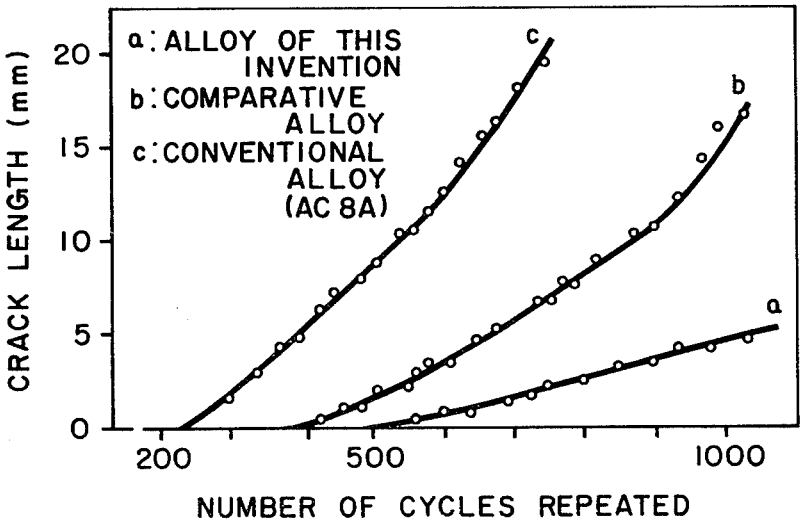
FIG. 3 compares an alloy of this invention, a conventional alloy designated by JIS (Japanese Industrial Standards) as AC8A and a comparative alloy with respect to thermal shock resistance.

FIG. 3 shows the results of tests which demonstrate the excellent thermal shock resistance of the alloy according to this invention. The tests were conducted to compare an alloy of this invention containing 9.2% by weight of silicon, 3.3% by weight of copper, 0.9% by weight of magnesium, 0.15% by weight of antimony and 0.41% by weight of nickel, the balance being aluminum and impurities; a comparative alloy containing 0.6% by weight of nickel; and the conventional alloy corresponding to Sample No. 7 in Example 2. The tests were conducted on each alloy subjected to six hours of solution heat treatment at 500° C., quenched in water and subjected to eight hours of tempering at 200° C.

A test sample was prepared from each alloy in the form of a disk having a diameter of 100 mm and a thickness of 3 mm, and provided in its center with a hole having a diameter of 5 mm. Each sample was rapidly heated in its center by a gas burner, and when the whole sample had reached a temperature of 350° C., it was immediately quenched in water having a temperature of about 20° C. As a cycle defined by such rapid heating and quenching was repeated, thermal stress was created in the sample by internal constraint, and the sample began to crack around its central hole. The number of cycles which had been repeated when such cracking first appeared and when the crack had grown to various lengths were determined for comparing alloys with respect to thermal shock resistance.

As is obvious from FIG. 3, the alloy of this invention is by far superior to the conventional AC8A alloy in thermal shock resistance, since the former began to crack after considerably more cycles than the latter, and its crack grew at a definitely lower rate (compare curves a and c). FIG. 3 also indicates that the addition of nickel in a quantity over 0.5% by weight results in a drastic reduction in the thermal shock resistance of the alloy (compare curve b with curve a).

What is claimed is:

1. An aluminum alloy for casting purposes which consists essentially of over 6% and up to 13% by weight of silicon, over 2% and up to 5% by weight of copper, over 0.25% and up to 1% by weight of magnesium, over 0.1% and up to 0.5% by weight of nickel and over 0.03% and up to 1% by weight of antimony, the balance being aluminum and impurities, said copper and said magnesium having a ratio by weight of about 3:1 to 8:1.

2. An alloy as set forth in claim 1, further including at least one member selected from the group consisting of; more than 0.1% but not more than 0.5% by weight of zirconium; more than 0.1% but not more than 1% by weight of manganese.

3. An alloy as set forth in claim 1, containing more than 0.03% but not more than 2.0% by weight of titanium.

4. An alloy as set forth in claim 2, containing more than 0.03% but not more than 2.0% by weight of titanium.

* * * * *